United States Patent [19]

Hazar et al.

[11] Patent Number: 4,979,237

[45] Date of Patent: Dec. 25, 1990

[54] DISPOSABLE SANITARY PROTECTOR COVER FOR TOILET

[76] Inventors: Mitchell M. Hazar, 8618 N. Fairview Dr., Scottsdale, Ariz. 85258; Carl F. Fries, 1548 West Campbell, Phoenix, Ariz. 85015

[21] Appl. No.: 398,935

[22] Filed: Aug. 25, 1989

[51] Int. Cl.[5] ..... A47K 13/14

[52] U.S. Cl. ..... 4/242; 4/243; 4/244

[58] Field of Search ..... 4/242–247

[56] References Cited

U.S. PATENT DOCUMENTS

| | | | |
|---|---|---|---|
| 966,838 | 8/1910 | Jaffee et al. | 4/243 |
| 1,155,260 | 9/1915 | Meyer | 4/243 |
| 1,202,494 | 10/1916 | Earley | 4/243 |
| 1,257,771 | 2/1918 | Wells | 4/243 |
| 1,284,077 | 11/1918 | Ennis | 4/243 |
| 1,452,552 | 4/1923 | Freon | 4/247 |
| 1,635,072 | 7/1927 | De Luna | 4/243 |
| 1,835,787 | 12/1931 | Knisely | 4/243 |
| 1,999,676 | 4/1935 | Wilkniss | 4/243 X |
| 2,000,566 | 5/1935 | Lichtenstein | 4/243 |
| 3,587,119 | 6/1971 | Freses | 4/242 |
| 3,588,921 | 6/1971 | Nagel | 4/243 |
| 3,753,262 | 8/1973 | Watsky | 4/243 |
| 3,851,341 | 12/1974 | Aoyama | 4/242 |
| 4,745,640 | 5/1988 | Nelson | 4/243 |
| 4,766,617 | 8/1988 | Thygesen et al. | 4/242 |
| 4,850,061 | 7/1989 | Engel | 4/243 |
| 4,875,242 | 10/1989 | Albrecht et al. | 4/243 |

*Primary Examiner*—Henry K. Artis

*Attorney, Agent, or Firm*—Gregory J. Nelson

[57] ABSTRACT

A disposable protector for toilet seats having a cover of paper or similar material with a center cut-out generally conforming to the opening in the seat. The cover has a retainer member which may be in the form of a flange or tab which engage the inner edge of the seat to temporarily secure the protector in place during use. The underside of the cover may also have a frictional material such as latex or a low-tack adhesive. The cover may be treated with a suitable anti-bacterial agnt and may be provided to the consumer in a dispenser or in individualized packages that may be conveniently carried by the user.

2 Claims, 4 Drawing Sheets

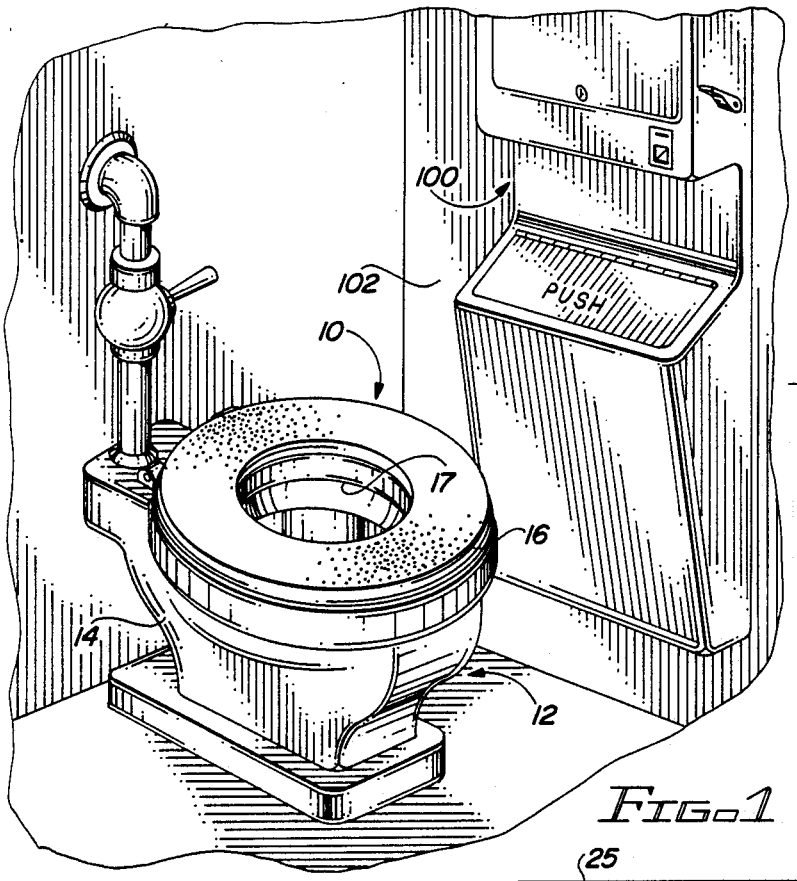
FIG. 1
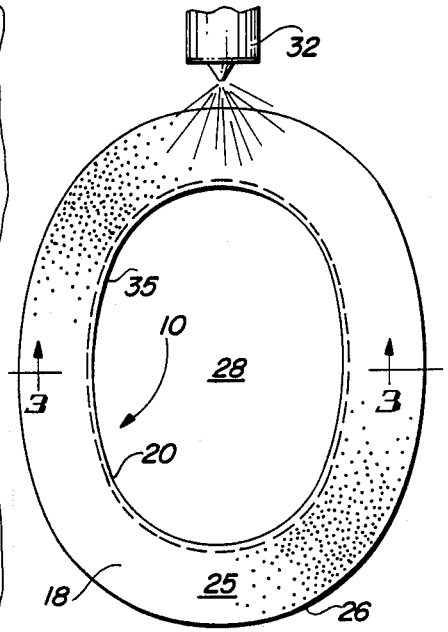
FIG. 2
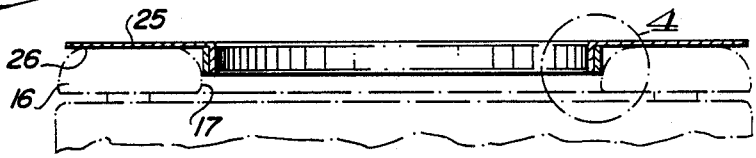
FIG. 3
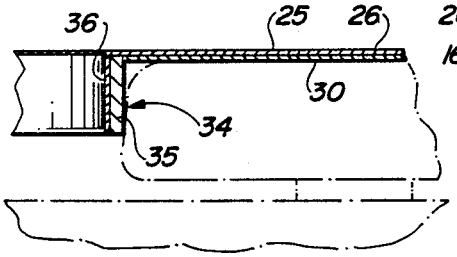
FIG. 4
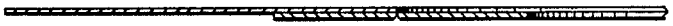
FIG. 6
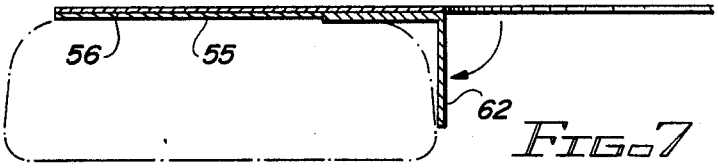
FIG. 7
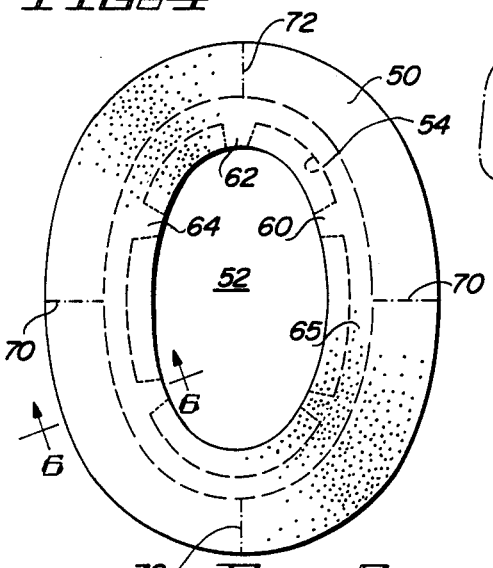
FIG. 5
FIG. 8
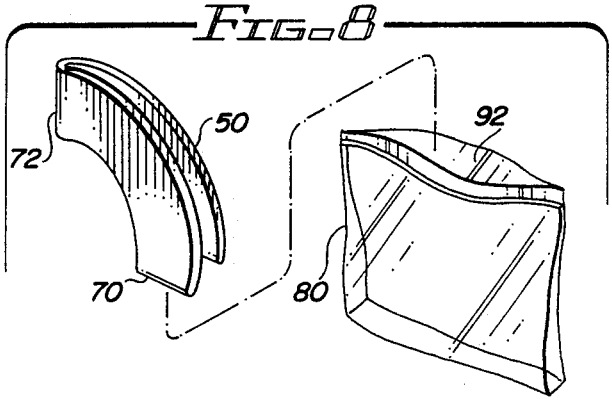

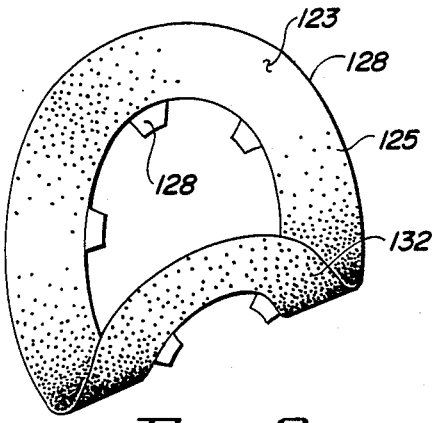
FIG. 9
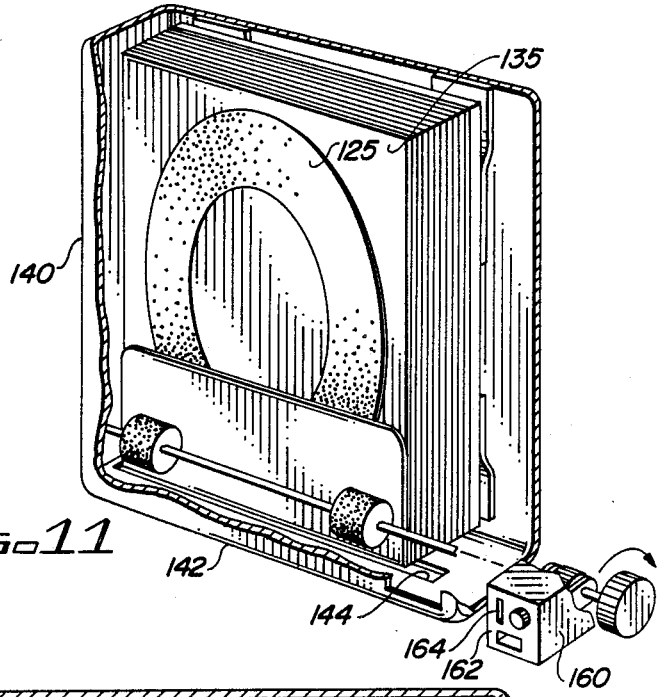
FIG. 11
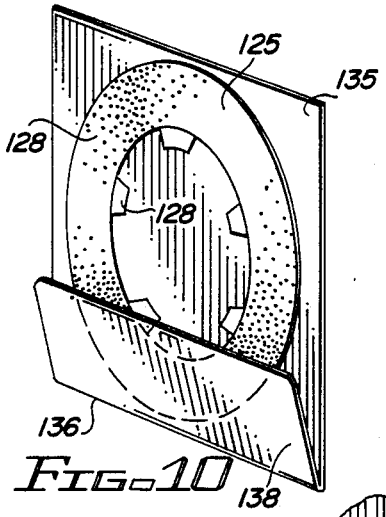
FIG. 10
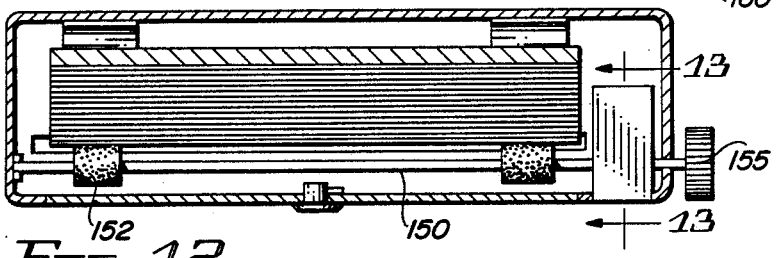
FIG. 12
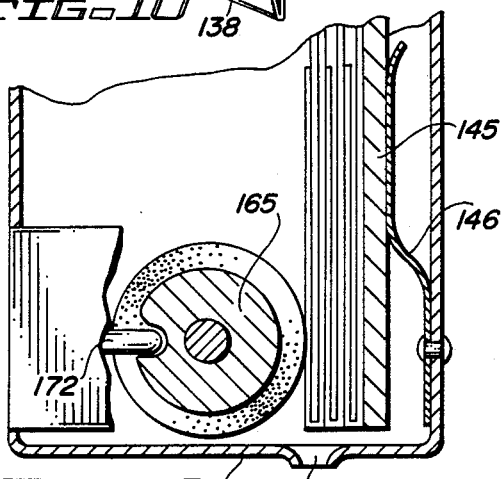
FIG. 13
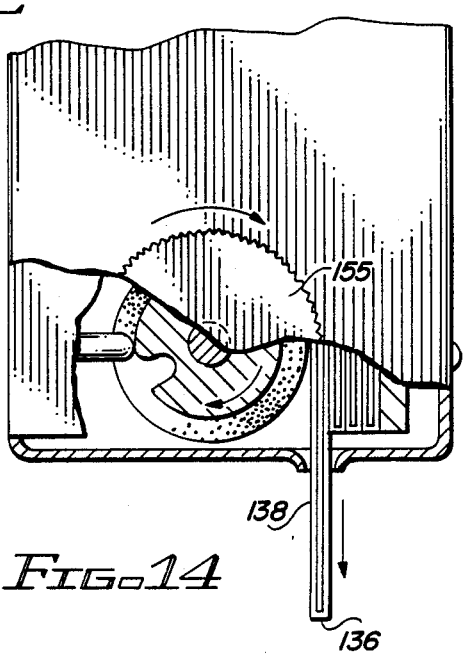
FIG. 14
FIG. 15
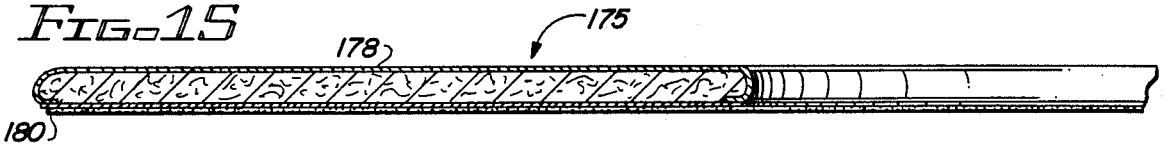

DISPOSABLE SANITARY PROTECTOR COVER FOR TOILET

The present invention relates to a sanitary product and more particularly relates to a disposable, personal, protector which covers the seat portion of a toilet, particularly public toilets.

Public health concerns have resulted in many public toilet facilities in restaurants, airports, aircraft and similar places providing toilet seat covers These toilet seat covers generally consist of a sheet of paper with a partially cut-out center section When placed in use, the center section must be torn away or partially separated from the rest of the cover and the cover is then placed on the toilet seat. Conventional paper covers are inadequate in a number of respects in that they are often flimsy and will easily tear interfering with their intended use. Also, since these prior art covers are simply placed over the seat, they are easily displaced and may slip from the toilet seat during use.

For these reasons, the prior art covers are generally inadequate and ineffective for their intended purpose.

Accordingly, there exists a need for an effective sanitary protector for toilet seats, particularly public toilet seats which protectors are disposable and will remain in proper position on the toilet seat during use.

Briefly, the present invention comprehends a disposable sanitary protector for toilet seats having a cover which is generally annular in shape with a center cut-out generally conforming to the inner periphery of the toilet seat. The cover is fabricated from a suitable flexible or semi-rigid material and may be fabric, paper or plastic. The interior edge of the cover is provided with retainer members which may be in the form of a peripherally extending flange or a plurality of bendable tabs which are engageable with the inner edge of periphery of the toilet seat to assist in temporarily maintaining the cover in position on the seat. In addition, the underside of the cover is coated or partially coated with a non-slip material such as a latex covering or a low-tack adhesive. The material of the cover may be coated or impregnated with a suitable anti-bacterial agent.

In other embodiments, the protector may be provided as part of a system for use in public toilet facilities which includes a dispenser for vending or dispensing the cover and a suitable waste container for disposal of the covers after use. The covers may also be provided in a folded compact form in a package which may be carried by the individual and which can be used to receive the used cover at the time of disposal.

The above and other objects and advantages of the present invention will become more apparent from the following specification, claims and drawings in which:

FIG. 1 is a perspective view of a toilet privacy stall with the protector of the present invention in place and further showing the dispenser and waste receptacle for the protector;

FIG. 2 is a plan view of the protector of the present invention;

FIG. 3 is a sectional view taken along line 3—3 of FIG. 2;

FIG. 4 is an enlarged detail view of a portion of the protector as indicated in FIG. 3;

FIG. 5 is a plan view of an alternate embodiment of the protector of the present invention;

FIG. 6 is a sectional view taken along line 6—6 of FIG. 5;

FIG. 7 is a partial detail view similar to FIG. 6 view showing the retainer tabs in an engaged position;

FIG. 8 illustrates the protector in a folded position along with packaging for the folded protector;

FIG. 9 is a plan view of an alternate embodiment of the protector with an edge of the protector reversely folded;

FIG. 10 is a perspective view illustrating the embodiment of FIG. 9 on a backing sheet suitable for dispensing;

FIG. 11 is a perspective view of a dispenser for the protector;

FIG. 12 is a top view partly in section of the dispenser shown in FIG. 11;

FIG. 13 is a sectional view taken along line 13—13 of FIG. 12;

FIG. 14 is a partial side view of the dispenser partly broken away to illlustrate the dispenser mechanism;

FIG. 15 is a longitudinal view of another embodiment of the protector partly in section;

Figure 16:
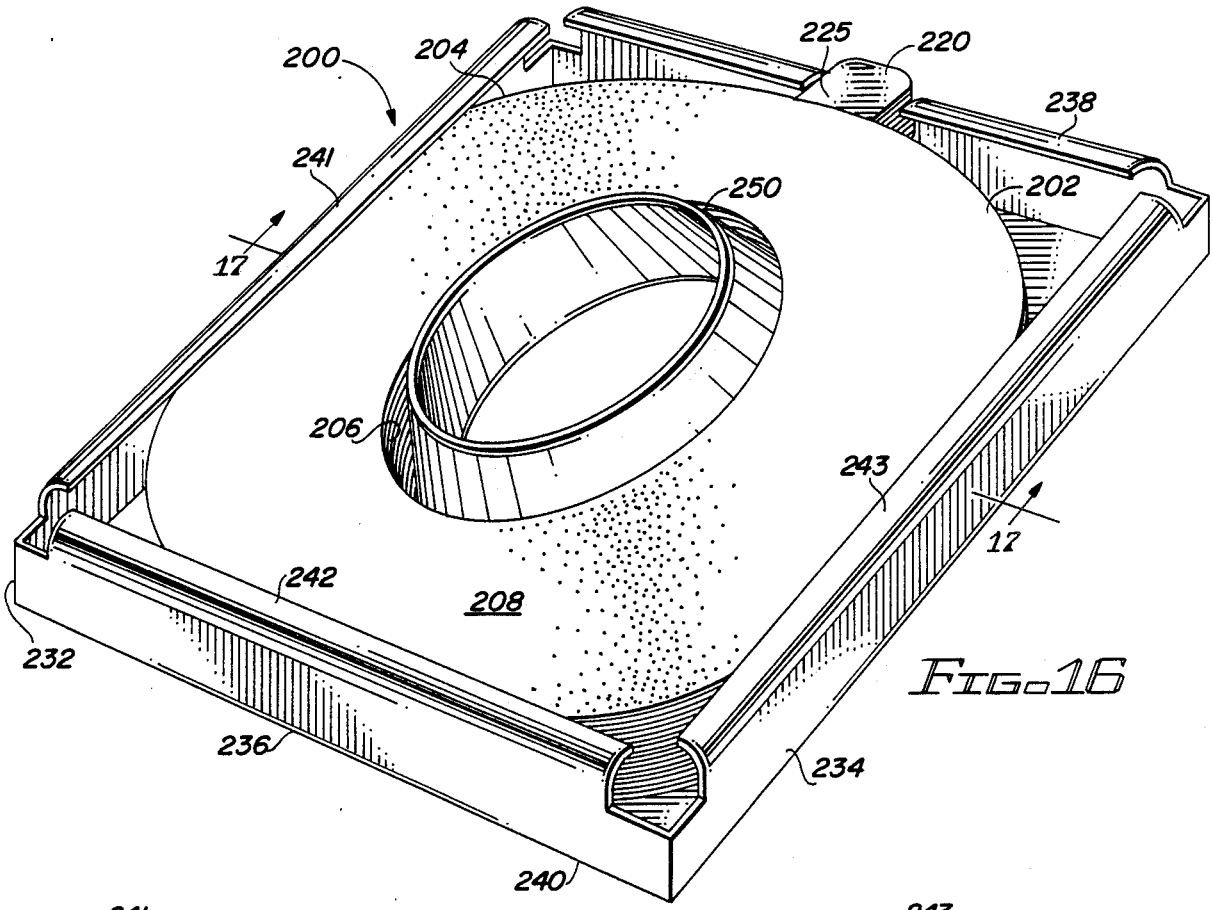
FIG. 16 is a perspective view of another embodiment of the protector of the present invention shown in alternate form of dispenser.

Turning now to the drawings, particularly FIGS. 1 to 4, the protector 10 is shown in conjunction with conventional toilet 12. Toilet 12 has a porcelain bowl 14 and a seat 16 of wood or plastic which is hinged to the rear part of the bowl and may be raised and lowered as desired. The seat 16 is generally oval-shaped with a generally oval central opening 17. As best seen in FIGS. 1 and 2, the protector 10 is adapted to be placed on the seat 12 and in use has a generally oval or circular outer edge 18 and an inner edge 20 which defines a generally circular or oval opening 28. The cover consists of one or more plies of a suitable flexible or semi-rigid material such as paper, plastic or a light cardboard and has an upper surface 25 and a lower surface 26. The cover may be fabricated by any conventional means such as die cutting.

The lower surface 26 of the protector is preferably coated or partially coated with a material to provide frictional engagement with the toilet seat 12. A thin coating of latex rubber or a low-tack adhesive is suitable for this purposes and is represented by the numeral 30 in FIG. 4. The upper surface of the cover may be treated with a suitable anti-bacterial agent such as Pseudomonse Luorense which may be applied directly to the cover by spray applicator 32 at the time of fabrication as shown in FIG. 2.

In order to further minimize the displacement or slipping of the protector with respect to the toilet seat, retainer means 34 are provided. As shown in FIGS. 1 to 4, the retainer means consist of a generally oval or circular flange 35 projecting downwardly around the inner edge 20 of the protector. The flange is preferably semi-rigid made of stiff cardboard or plastic and may be attached to the protector at peripherally extending lip 36 by an adhesive.

When the protector is placed in the position of use as shown in FIG. 1, the lower surface 26 of the protector having frictional characteristics will minimize slipping of the protector on the toilet seat. As best seen in FIGS. 3 and 4, retainer 34 has its flange extending downwardly which engages the interior edge of the seat 17 to further minimize the possibility of displacement of the protector.

FIGS. 5 to 7 show another embodiment of the protector which again includes a generally annular cover member 50 having a shape generally conforming to a conventional toilet seat with a central opening 52 defined by edge 54. The cover is fabricated from a suitable material and may have a frictional or adhesive coating 55 on the lower surface 56. The retainer members 60 are shown as a plurality of tabs 62 defined by score lines 64 in an annular member 65 which is sewn or adhesively joined to the inner edge of the cover. The annular member is fabricated of a semi-rigid material and when placed in use, selected of the tabs 62 may be bent downwardly as shown in FIG. 7 to form projections which will engage the inner edge of the toilet seat to further minimize displacement of the cover relative to the seat.

The protector of the invention may be variously packaged for the convenience of the user. As shown in FIG. 8, the protector of FIG. 5 which has been designated by the numeral 50 is shown in a folded position having been folded about horizontal fold line 70 and vertical fold line 72 resulting in a folded article in the form of an arcuate strip. In this reduced, compact size, the cover may be suitably provided to the user in a package 80 which is shown as a polyethylene bag having a reclosable closure means 95 at the upper end. In this compact condition, a personal supply of the protectors can be conveniently carried by the user in a handbag or briefcase and after use may be folded and replaced in the bag 80 for disposal.

As seen in FIG. 1, the protector of the invention may also be conveniently provided to the user in the privacy of a toilet stall in a dispenser unit 100 which also includes a suitable waste receptacle 102 for disposal of the protector after use. The inclusion of the waste receptacle will provide an alternate disposal location other than the toilet as disposal in the toilet may cause plumbing problems FIGS. 9 and 10 show the protector suitably packaged for dispensing and FIGS. 11 to 14 illustrate the details of the dispenser unit. Referring to FIGS. 9 and 10, the protector is designated by the numeral 125 and is generally as has been described above having an annular configuration conforming to the shape of a conventional toilet seat. Bendable retainer members 128 are provided to engage the interior seat rim to prevent slippage of the cover. The protector has a top surface 123 and a lower surface 132 which lower surface is coated or partially coated with a low-tack adhesive. As supplied to the user, the protector is detachably affixed to a generally rectangular backing sheet 135 as seen in FIG. 10. A lower edge of the backing sheet is forwardly folded about a transverse fold line 136 forming a flap 138 which overlies a part of the backing sheet as well as the lower edge of the cover to prevent the cover from separating from the backing sheet when stored and dispensed. When the cover 125 is dispensed and ready for use, it is peeled from the backing sheet 135 and placed on the toilet seat. The low-tack adhesive on the lower side of the cover will help maintain the protector in proper position as will the retainer tabs 128.

The cover package consisting of a backing-mounted cover shown in FIG. 10 is partially adapted for containment in a dispenser cabinet such as that shown in FIGS. 11 to 14. The cabinet 140 is preferably wall-mounted as shown in FIG. 1 adjacent the toilet or within the individual privacy stall. The cabinet is generally rectilinear having a horizontal bottom edge 142 defining a dispensing slot 144. A plurality of the individual covers 125 with attached backing sheets 135 are stacked within the cabinet. As best seen in FIG. 13, a pusher plate 145 engages the rear of the stack of backing sheet covers which are urged forwardly by a plurality of leaf springs 146 interposed between the pusher plate and the rear wall of the cabinet. A dispenser mechanism includes a horizontally extending shaft 150 having one or more soft rubber rollers 152 which engage the lower horizontal edge of the forward-most backing sheet and protector. The shaft is manually actuated by means of a knob 155 and when rotated clockwise as shown, will through the frictional engagement of the rubber rollers, move the forward-most backing sheet and contained protector downwardly so an edge of the backing sheet protrudes through slot 144 to allow the backing sheet to be grasped by the user and the sheet and cover pulled from the dispenser cabinet.

If desired, the operation of the shaft can be controlled by a coin box lock mechanism 160 as shown. The coin box lock mechanism has a housing 162 with a slot 164 for reception of coin. A cylinder 165 is secured to the dispenser shaft and the shaft is normally in a locked position due to engagement of spring-loaded lock pin 172. The insertion of a coin in the coin slot 164 will release the lock pin 172 allowing the shaft to be rotated one complete turn dispensing one of the cover packages. Spring loaded lock pin dispensing mechanisms of this type are well known in the art and this type is shown only for purposes of illustration.

When the user wishes to dispose of the cover, a waste receptacle 102 is provided for this purpose as shown in FIG. 1. The convenience of a container such as receptacle 102 will discourage users from attempting to dispose of either the protector or the packaging in which the cover is contained in the toilet.

Another embodiment cf the cover is shown in FIG. 15 which is generally designated by the numeral 175. In this embodiment, the protector is again generally in the shape of an annulus but is formed as an envelope having an upper panel 178 and a lower panel 180. Upper panel 178 is a soft, flexible material such as a thin paper. The lower surface may be of a more rigid or stiff material than the upper surface and may be plastic or a rigid paper or cardboard. The area within the envelope contains a thin layer of resilient material 180 such as a fibrous padding similar to the material used in disposable diapers. The exterior of the lower panel is provided with at least a partial coating of a frictional material 182 such as a latex material or low-tack adhesive to prevent slipping relative to the toilet seat. The cover may be treated with an anti-bacterial agent and is preferably further provided with retainer members which engage the inner circular edge of the toilet seat as has been described with reference to FIGS. 3 to 8.

In other respects, the embodiment of FIG. 15 may be similar to those described above and may be folded and packaged for individual use or may be packaged for dispenser use.

Figure 17:
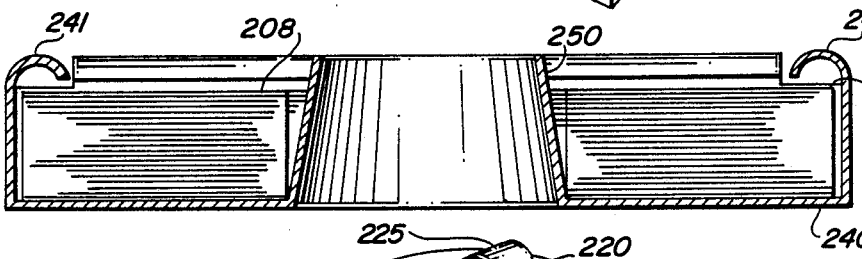
FIG. 17 is a sectional view taken along line 17—17 of FIG. 16.
Figure 18:
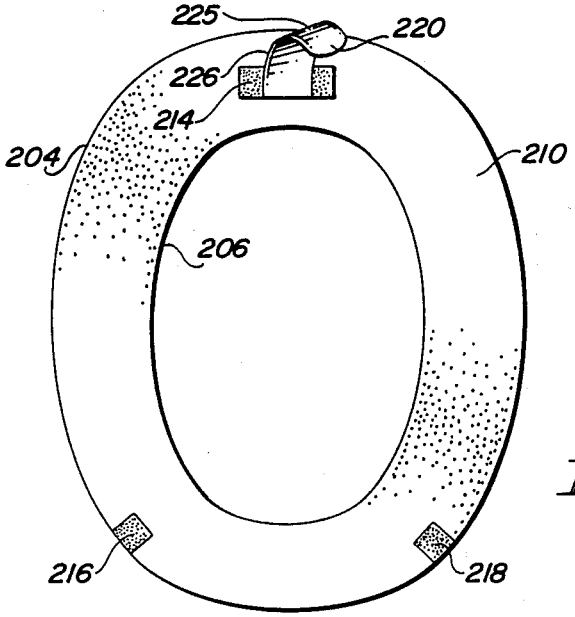
FIG. 18 is a bottom plan view of the protector shown in FIGS. 16 and 17.

FIGS. 16 through 18 show another embodiment of the present invention generally designated by the numeral 200. In this embodiment, the protectors 202 are again generally shaped to conform to a conventional toilet seat each having an outer peripheral edge 204 and an inner peripheral edge 206 defining a generally annular shape. The protectors are preferably made of a lightweight paper having a hard or calendared upper surface 208 to provide moisture resistance. The underside 210 of the cover is seen in FIG. 18 and is treated to minimize slipping having areas 214, 216 and 218 which are coated with a low-tack adhesive. A tab 220 is detachably secured to area 214. Tab 220 has an enlarged pull 225 which extends beyond the peripheral edge 204 of the protector and the body 226 of the tab 220 engages the low-tack area 214. In use, the tab 220 assists the user in removing a protector from the stack and thereafter removing and positioning the protector on the toilet seat with the bottom surface 210 engaging the toilet seat surface. The low-tack areas 214, 216 and 218 will serve to temporarily secure the protector to the seat and prevent slipping and displacement of the protect<,r during use. Once the protector has been used, it may be disposed of in an appropriate waste receptacle or may be disposed of in a toilet since the material is preferably a biodegradable paper compatible with plumbing systems and will deteriorate in water.

The protector 210 is preferably provided in a dispensing container 230 as best shown in FIGS. 16 and 17. The container 230 is generally rectilinear having opposite side walls 232 and 234, end walls 236 and 238, and bottom 240. The dimensions of the container approximately correspond to the major length and width of the protector 202. The upper edges of side walls 232 and 234 and end wall 236 are provided with inwardly turned flanges 241, 242 and 243, respectively. Inwardly extending flanges 241, 242 and 243 each overly a portion of the protector contained within the dispenser as best seen in FIG. 17 to releasably retain the covers within the dispenser. A sleeve 250 which is generally cylindrical, projects upwardly from bottom 240 so that the stacked covers fit loosely about the sleeve. It will be noted that end wall 238 is not provided with an inwardly turned lip so that in the stacked condition the tabs 220 are readily accessible to the user.

The dispenser/container may be placed on a horizontal surface or may be secured to a vertical surface such as a wall in the privacy stall or adjacent the toilet. When a cover is to be used, the pull portion 220 of the tab is grasped and pulled forwardly as indicated by the arrow in FIG. 16. Since the covers are flexible, this application of force will cause the cover to be released from the container. The tab can then be easily separated from the underside of the cover at low-tack area 226 and discarded. The cover is then placed on the toilet seat with the low tack areas engaging the toilet seat.

Tab 220 is shown as being detachably secured to the underside of the cover at low tack adhesive area 214. Alternatively, the tab can be formed as an integral part of the cover extending from the outer peripheral edge 204 of the cover at a location along the front edge portion. The tab can be die cut as part of the cover to provide a surface that may be grasped by the user to separate a single protector from a dispenser.

Figure 19:
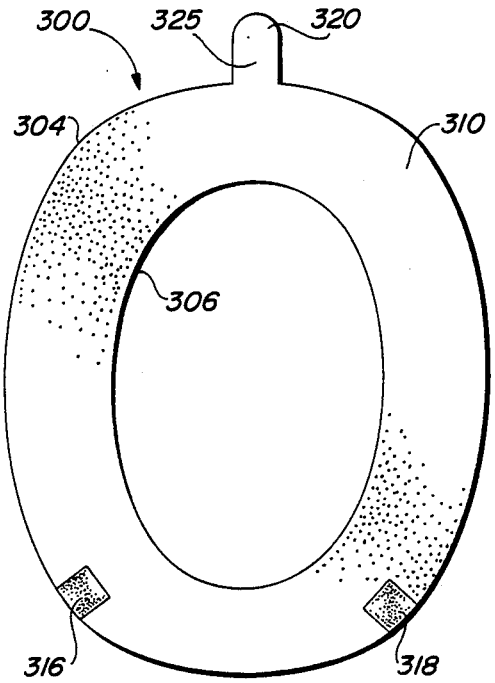
FIG. 19 is a bottom plan view of another embodiment of the cover similar to that shown in FIG. 18.

In FIGS. 19, the protector 310 is generally configured to conform to the shape of the toilet seat having an annular shaped body defined by outer edge 304 and inner edge 306. Adhesive areas 316, 318 are provided at spacedapart locations to provide temporary adherence to the toilet seat. The front portion of the outer edge is provided with an integrally formed tab 325 having a pull 320 to assist the user in grasping and removing an individual protector when provided in a dispenser of the type shown in FIGS. 16 and 17.

Figure 21:
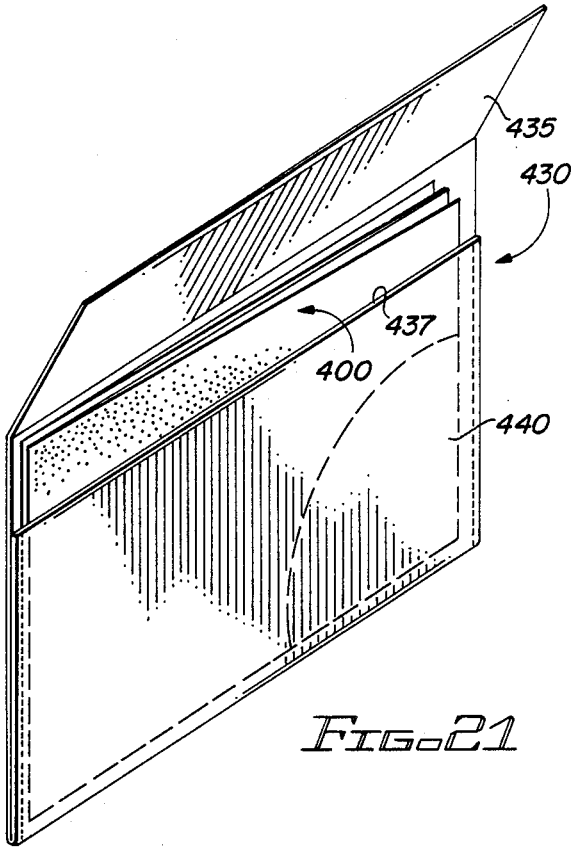
FIG. 21 shows the cover of FIG. 21 contained in a package suitable for storage in a purse or handbag.
Figure 20:
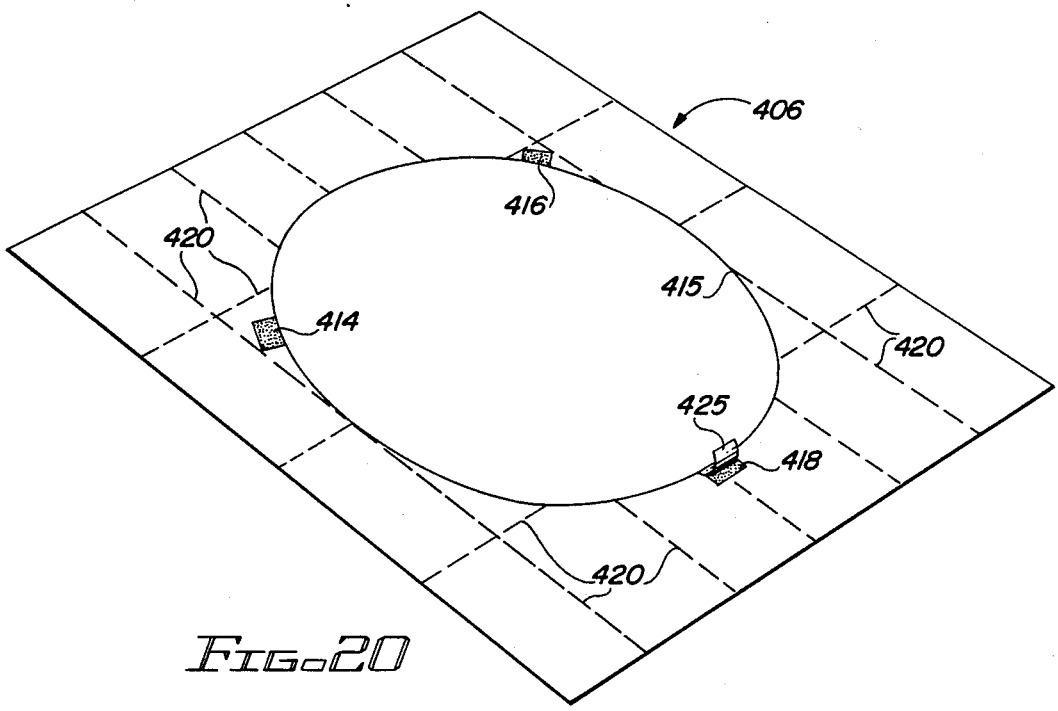
FIG. 20 illustrates another embodiment of the cover suitable for folding to a compact condition.

FIGS. 20 and 21 show still another form of the protector suitable for individualized packaging. The protector 400 is shown as being generally rectangular having a central opening 415. A plurality of adhesive sections 414, 416 and 418 are provided about the opening 415 on the undersurface of the protector as seen in FIG. 20. The protector is preferably of a flexible paper or cloth material and is foldble along intersecting fold lines 420 into a compact, generally rectangular condition. Preferably, the adhesive section 414, 416 and 418 are provided with a peelable cover 425 which is easily removed at the time of use. A similar peelable cover may be applied to any of the protectors described herein having an adhesive section on one surface.

The folded protector is provided to the consumer in an envelope 430 having a pocket 440 for receiving the protector. The flap 435 of envelope 430 is manually lifted exposing a portion of the protector above edge 437 so the protector may be removed from the envelope for use. One or more of the protector-containing envelopes may be provided the consumer which may be easily kept in a handbag, purse or on the person available for use.

It will be obvious to those skilled in the art to make various changes, alterations and modifications to the protector described herein. To the extent such changes, alterations and modifications do not depart from the spirit and scope of the appended claims, they are intended to be encompassed therein.

I claim:

1. A sanitary protector for a toilet seat having an inner and outer peripheral edge comprising:

(a) a cover having a top and bottom surface and having an inner and outer edge, said inner edge of said cover defining an opening generally corresponding to the inner peripheral edge of the toilet seat;

(b) retainer means associated with the bottom side of said cover adapted to releasably engage at least a portion of the toilet seat to at least temporarily retain said cover in position on the seat, said retainer means comprising adhesive covering at least a portion of said cover;

(c) tab means extending beyond the outer edge of said cover; and (d) dispenser means containing a plurality of said protectors in a stacked condition in said dispenser, said dispenser means including a housing having a wall member overlying at least a portion of the stacked protectors whereby a selected one of said protectors in said stack may be released from the dispenser by grasping said tab means and pulling a selected of said protectors free of said container; and (e) said dispenser further including a sleeve member associated with said dispenser having a shape generally corresponding to the inner edge of said protector and wherein said protectors are positioned in said container with their said inner edge disposed about said sleeve.

2. The sanitary protector of claim 1 wherein said tab means releasably engage said adhesive means and are removable therefrom at the time of use.

* * * * *